US008674247B2

(12) United States Patent
Lin et al.

(10) Patent No.: US 8,674,247 B2
(45) Date of Patent: Mar. 18, 2014

(54) SWITCH PANEL WITH INDICATOR

(75) Inventors: Hung-jung Lin, Taipei (TW); Shao-lun Chao, Taipei (TW); En-chuan Tsui, Taipei (TW); Wen-chih Chang, Taipei (TW); Rung-huei Liang, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 187 days.

(21) Appl. No.: 13/274,297

(22) Filed: Oct. 14, 2011

(65) Prior Publication Data

US 2012/0292164 A1 Nov. 22, 2012

(30) Foreign Application Priority Data

May 16, 2011 (TW) ..... 100117086 A

(51) Int. Cl.
*H01H 71/16* (2006.01)

(52) U.S. Cl.
USPC ..... 200/315; 200/310; 200/311; 200/313; 200/317; 362/95

(58) Field of Classification Search
USPC ..... 200/296
See application file for complete search history.

(56) References Cited

U.S. PATENT DOCUMENTS

| | | | | |
|---|---|---|---|---|
| 3,872,294 | A * | 3/1975 | O'Toole | 362/85 |
| 2006/0283697 | A1 * | 12/2006 | Garfio | 200/310 |
| 2008/0006516 | A1 * | 1/2008 | Nishino et al. | 200/345 |

OTHER PUBLICATIONS

After Turn Off completed by Hung-Jung Lin, Shao-Lun Chao, and En-Chuan Tsui, 8th Taiwan Design Expo Dec. 11, 2010.

* cited by examiner

*Primary Examiner* — Renee S Luebke
*Assistant Examiner* — Ahmed Saeed

(57) ABSTRACT

A switch panel with an indicator is disclosed. The switch panel has a transparent region. There is a light source disposed in the switch panel for emitting light when turning off a switch body. A shape of the transparent region is projected onto the wall for forming a large area of indicating pattern, and this can replace a night light. The drawback of a luminous region in prior art which is limited to be on the switch body or on the switch panel is solved.

9 Claims, 4 Drawing Sheets

SWITCH PANEL WITH INDICATOR

CROSS-REFERENCE

This application claims the priority of Taiwan Patent Application No. 100117086, filed on May 16, 2011. This invention is partly disclosed in a recognized exhibition, entitled "After Turn Off" completed by Hung-Jung Lin, Shao-Lun Chao, and En-Chuan Tsui, 8th Taiwan Design Expo on Dec. 11, 2010.

TECHNICAL FIELD OF THE INVENTION

The present invention relates to a switch, especially to a switch panel with an indicator.

BACKGROUND OF THE INVENTION

As to the design of a conventional switch, the user can't easily find the location of the switch in unfamiliar surroundings. However, even though the user who is familiar with the surroundings can't easily find the location of the switch to turn on it at night or in dark surrounding; thus, the conventional switch is inconvenient to use.

Therefore, it was suggested to dispose a tiny light on the switch button, so that the location of the switch can be shown when the lights are off, thereby omitting the need for searching when the lights are off and the inconvenience for exploring the switch.

However, the luminous region of the switch with an illuminant indicator is limited to only on the switch button or on the switch panel at present, so the luminous region is too small to find or is usually shielded by other objects. Therefore, the indicator effect of the conventional switch with the illuminant indicator is not enough.

Accordingly, there is an urgent need to improve the conventional technology to overcome the drawback in the prior art.

SUMMARY OF THE INVENTION

An objective of the present invention is provided a switch panel, which has a transparent region for projecting a larger area of indicating pattern so as to solve above mentioned drawback.

To achieve the foregoing objective, the present invention provides a switch panel for at least one switch body disposed on a wall. The switch panel includes a first wall body and a second wall body. The first wall body has at least one opening to hold the at least one switch body. The second wall body is coupled to the first wall body and the second wall body has a transparent region. A sharp angle is defined between the second wall body and the wall, and the transparent region faces toward the wall. In addition, the switch panel further includes a light source for emitting light, which the light is projected, passing through the transparent region of the second wall body, onto the wall.

In one preferred embodiment, the light source is a luminescence or an LED. In addition to the light source emits the light according to an on/off state of the at least one switch body.

In one preferred embodiment, a shape of the transparent region is selected from a group consisting of a figure, a word, a pattern, a symbol, and an image. Besides, the transparent region is a hollowed-out pattern, and there is a transparent film on the transparent region. For example, the shape of the hollowed-out pattern is a shape of an animal. It is worth mentioning that the second wall body is replaceable, so the indicating pattern can be replaced by means of replacing the second wall body having the different transparent regions.

In accordance with the switch panel of the present invention, the shape of transparent region can be projected onto the wall when the lights are off. In addition to showing the location of the switch, it also can take the place of a night light, and the drawback of the luminous region in the prior art which is limited to be only on the switch button or on the switch panel is overcome. Besides, it also is fun from the shape replacement through replacing the second wall body, thereby making people willing to turn off the light to have fun from the projecting pattern, so as to achieve an effect of energy conservation.

It is to be understood that both the foregoing general description and the following detailed description of the present invention are exemplary and explanatory and are intended to provide further explanation of the invention as claimed.

DETAILED DESCRIPTION OF THE INVENTION

Figure 1:
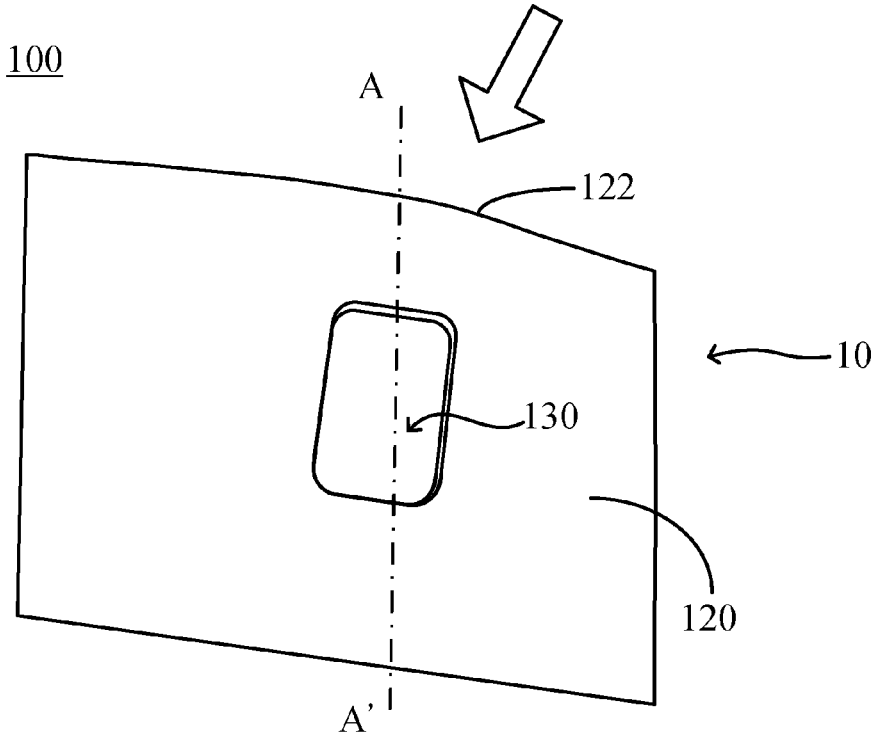
FIG. 1 is a perspective view illustrating a switch panel according to the preferred embodiment of the present invention.
Figure 2:
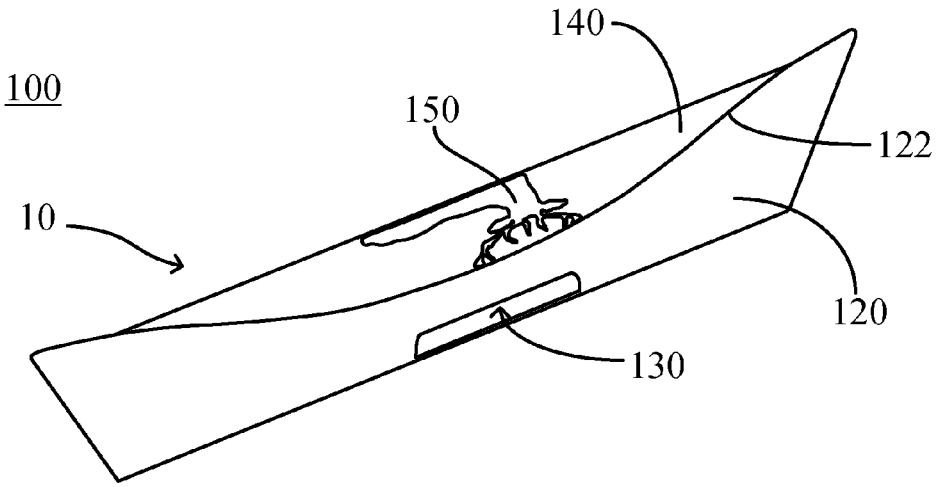
FIG. 2 is a perspective view illustrating the switch panel of FIG. 1 from the direction of the arrow.

The following will explain the switch panel which according to a preferred embodiment of the present invention in detail with drawings. The switch panel of the present invention is preferably utilized for a walled light switch, but it is not limited to the light switch in the present invention. Other switches with a light indicator can also be implemented. Referring to FIG. 1 and FIG. 2, FIG. 1 is a perspective view illustrating a switch panel according to the preferred embodiment of the present invention. FIG. 2 is a perspective view illustrating the switch panel of FIG. 1 from the direction of the arrow. The switch panel 10 is preferably utilized for at least on switch body 135(shown in FIG. 4) to be disposed on a wall 100 (as the paper shown). The first wall body 120 has at least one opening to hold the at least one switch body.

In the one preferred embodiment, the switch body of the switch panel 10 is implemented as a single switch button, but that using a plurality of the switch buttons is also within the scope of the present invention. A side edge 122 of the first wall body 120 is a curve which protrudes from the wall 100, so that the first wall body 120 protrudes from the wall about 1 CM at the side edge 122.

Figure 3:
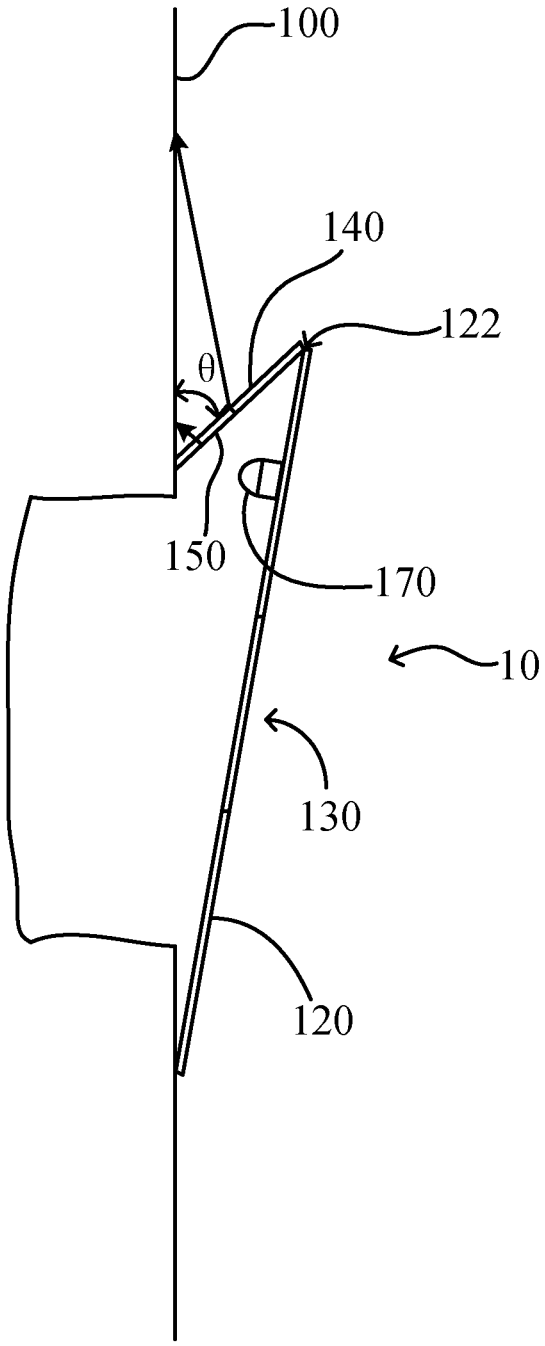
FIG. 3 is a cross-sectional view illustrating the switch panel of FIG. 1 along A-A'.

Referring to FIG. 2 and FIG. 3, FIG. 3 is a cross-sectional view illustrating the switch panel of FIG. 1 along A-A'. The second wall body 140 is coupled to the side edge 122 of the first wall body 120. That is, the second wall body 140 has a side similar to the outline of side edge 122, and the side is coupled to the first wall body 120. In addition, the second wall body 140 has a transparent region 150, and the shape of the transparent region 150 is selected from a group consisting of a figure, a word, a pattern, a symbol, and an image. In the preferred embodiment, the shape of transparent region 150 is a shape of an animal, such as a deer shown in FIG. 2. Besides, the transparent region 150 can be implemented as a hollowed-out pattern. However, in order to prevent dust falling into the transparent region 150 that is implemented as the hollowed-out pattern, there is a transparent film (not shown) on the transparent region 150. For example, the transparent film can be covered on the second wall body 140 from outside or inside so as to prevent the dust falling into the switch panel 10.

A sharp angle θ is defined between the second wall body 140 and the wall 100, so that the transparent region 150 faces toward the wall 100. It should be noted that the sharp angle θ is preferably between 10 degrees and 80 degrees. It is worth mentioning that the wall 100 has a cave for containing conventional piping equipments and IC boards of the switch, hence no further details are provided herein.

While the state of the switch body is off, a light source 170 disposed in the switch panel emits light. The light passes through the transparent region 150, and the shape of the transparent region 150 is projected onto the wall 100. It is worth mentioning that the second wall body 140 is replaceable, so the indicating pattern can be replaced by means of replacing the second wall body 140 having the different transparent regions 150. However, the present invention is not limited to implement as the replaceable type, and the first wall body 120 and the second wall body 140 can also be implemented with one body formed.

Figure 4:
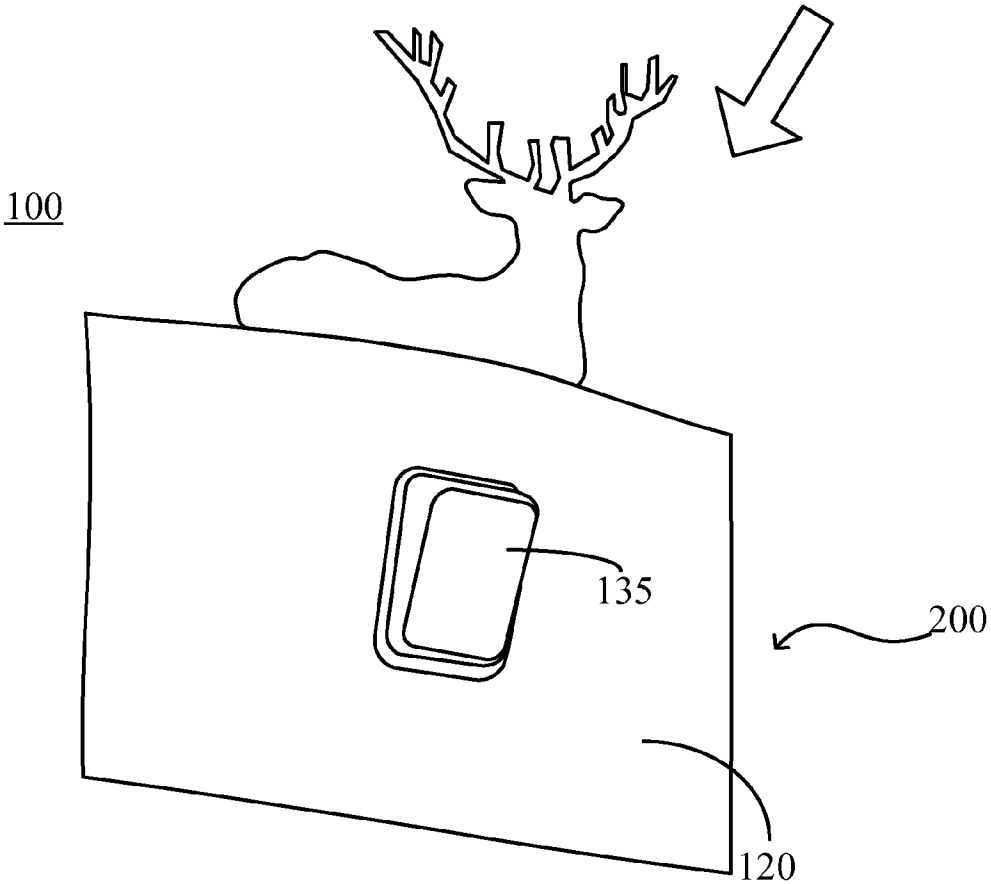
FIG. 4 is a perspective view illustrating a switch module according to the preferred embodiment of the present invention.
Figure 5:
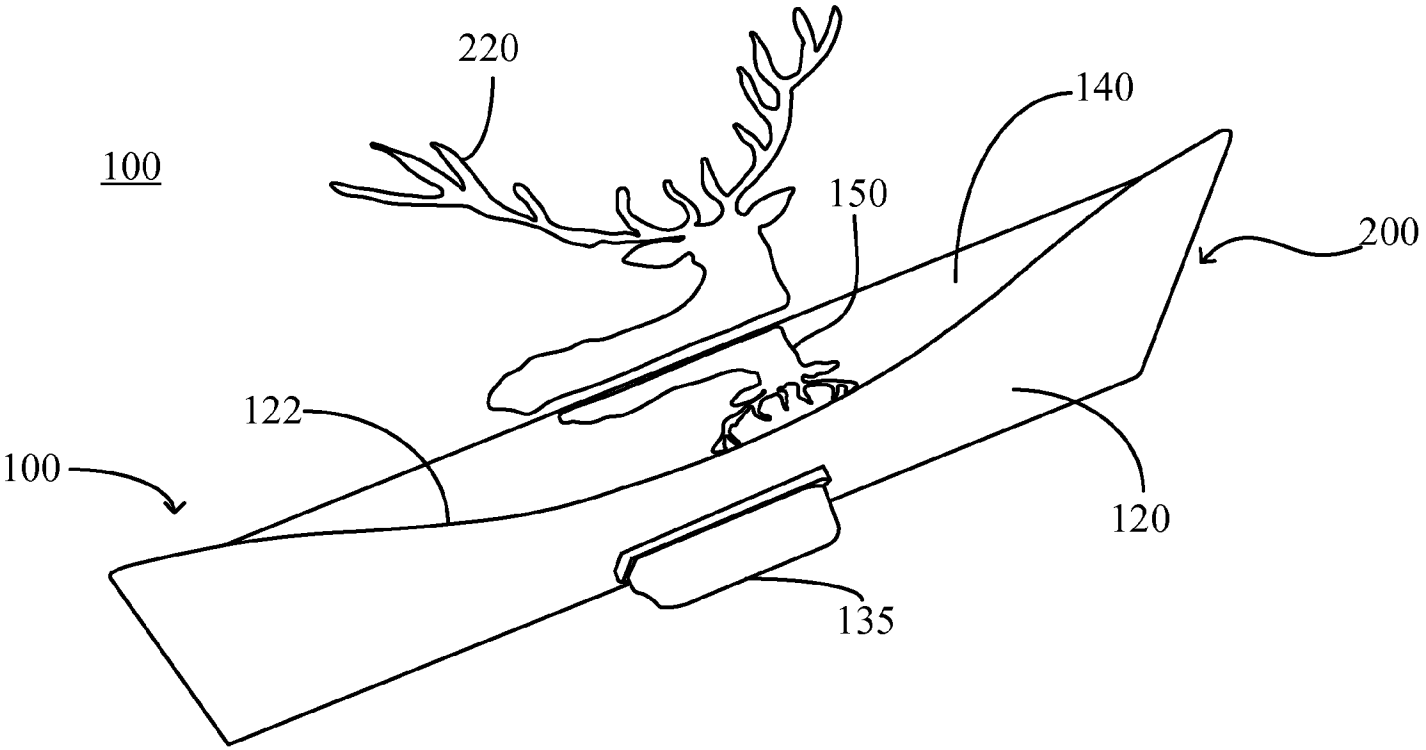
FIG. 5 is a perspective view illustrating the switch module of FIG. 4 from the direction of the arrow.

The following will explain the switch module of the above-mentioned switch panel 10 with the indicator. Referring to FIG. 4 and FIG. 5, FIG. 4 is a perspective view illustrating a switch module according to the preferred embodiment of the present invention. FIG. 5 is a perspective view illustrating the switch module of FIG. 4 from the direction of the arrow. The switch module is designated at the reference numeral 200.

The switch module 200 with the indicator according to the preferred embodiment of the present invention includes at least one switch body 135, a switch panel 10, and a light source 170, in which the switch panel 10 is the above mentioned preferred embodiment of the present invention.

The switch body 135 is implemented by a single switch button, but a plurality of the switch buttons are also within the scope of the present invention. Similarly, the switch panel 10 is disposed on the wall 10. The switch panel 10 includes the first wall body 120 and the second wall body 140. The first wall body 120 has at least one opening 130 (as shown in the FIG. 1) to hold the at least one switch body 135. The second wall body 140 is coupled to the side edge 122 of the first wall body 120, and the second wall body 140 has a transparent region 150. A sharp angle θ (as shown in the FIG. 3) is defined between the second wall body 140 and the wall 100, and the transparent region 150 faces toward the wall 100. The descriptions of the same elements have been explained as above mention, so we need not go into detail herein.

Please referring to FIG. 3 again, in the preferred embodiment, the light source 170 is disposed within the switch panel 10, and emits the light according to the on/off state of the at least one switch body 135, wherein the light is projected, passing through the transparent region 150, onto the wall 100. In one preferred embodiment, the light source 170 is disposed on the first wall body 120 so as to project the light on the second wall body 140. However, the present invention is not limited of the light source 170 only can be disposed on the first wall body 120. The light source 170 emits the light according to the off or on state of the at least one switch body 135. For example, the light is emitted when the switch body 135 is turned off, and. the light stops emitting when the switch body 135 is turned on.

It should be noted that the light 170 is a luminescence or an LED, which has the advantage of saving energy and high brightness. Similarly, the second wall body 140 of the switch panel 10 is replaceable, and the shape of the transparent region 150 is selected from a group consisting of a figure, a word, a pattern, a symbol, and an image. The indicating pattern projected onto the wall 100 is elongated in a certain proportion according to the angle of the second wall body 140 and the location of the light source 170. The projecting shape 220 that is larger than the switch panel 10 can be designed easily through simply geometrical optics.

In accordance with the switch panel 10 of the present invention, the shape of transparent region 150 can be projected onto the wall 100 when the lights are off. In addition to showing the location of the switch module 200, it also can take the place of the night light, and the drawback of the luminous region in the prior art which is limited to be only on the switch button or on the switch panel is solved. Besides, it also is fun from the shape replacement through replacing the second wall body 140, thereby making people willing to turn off the light to have fun from the projecting pattern, so as to achieve the effect of energy conservation.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims

What is claimed is:

1. A switch panel for at least one switch body disposed on a wall, the switch panel comprising:

a first wall body having at least one opening holding the at least one switch body;

a second wall body coupled to the first wall body, the second wall body and the first wall body protruding from the wall, the second wall body having a transparent region, wherein a sharp angle is defined between the second wall body and the wall, and the transparent region faces toward the wall; and a light source disposed within the first wall body and the second wall body for emitting light, wherein the light is projected upwardly, passing through the transparent region of the second wall body, onto the wall.

2. The switch panel of claim 1, wherein the light source is a luminescence.

3. The switch panel of claim 1, wherein the light source is an LED.

4. The switch panel of claim 1, wherein the light source emits the light according to an on/off state of the at least one switch body.

5. The switch panel of claim 1, wherein a shape of the transparent region is selected from a group consisting of a figure, a word, a pattern, a symbol, and an image.

6. The switch panel of claim 5, wherein the transparent region is a hollowed-out pattern.

7. The switch panel of claim 6, wherein a shape of the hollowed-out pattern is a shape of an animal.

8. The switch panel of claim 1, wherein there is a transparent film on the transparent region.

9. The switch panel of claim 1, wherein the second wall body is replaceable.

* * * * *